US007043146B2

(12) United States Patent
Semaza

(10) Patent No.: US 7,043,146 B2
(45) Date of Patent: May 9, 2006

(54) ALL SEASON HEAT FAN WITH ELECTRIC HEATING ELEMENTS POWERED BY ROTATING RINGS AND BALL BEARINGS

(76) Inventor: Solomon Semaza, 24 Avenue A, Freehold, NJ (US) 07728

( * ) Notice: Subject to any disclaimer, the term of this patent is extended or adjusted under 35 U.S.C. 154(b) by 0 days.

(21) Appl. No.: 11/117,136

(22) Filed: Apr. 28, 2005

(65) Prior Publication Data

US 2005/0196158 A1 Sep. 8, 2005

Related U.S. Application Data

(63) Continuation-in-part of application No. 10/734,973, filed on Dec. 15, 2003, now abandoned.

(51) Int. Cl.
*F24H 3/00* (2006.01)
*H05B 3/00* (2006.01)

(52) U.S. Cl. ..... 392/362; 416/95; 219/541

(58) Field of Classification Search ..... 392/362; 416/95, 39, 5; 244/134 D; 219/541, 544, 219/542

See application file for complete search history.

(56) References Cited

U.S. PATENT DOCUMENTS

| | | | | |
|---|---|---|---|---|
| 1,737,912 | A | 12/1929 | Bogard | |
| 1,784,528 | A | 12/1930 | Lidke et al. | |
| 2,110,621 | A | 3/1938 | Cohen | |
| 5,230,606 | A | 7/1993 | Chin-Fu | |
| 2002/0192075 | A1* | 12/2002 | Block | 415/176 |

FOREIGN PATENT DOCUMENTS

| | | | |
|---|---|---|---|
| EP | 946211 | A2 | 12/1999 |
| FR | 942017 | | 7/1949 |
| GB | 2172935 | A | 10/1986 |
| IT | 464906 | | 4/1951 |

* cited by examiner

*Primary Examiner*—John A. Jeffery
(74) *Attorney, Agent, or Firm*—Sperry, Zoda & Kane

(57) ABSTRACT

An all season fan with heated circulating blades includes heating elements mounted in slots defined in the rear surface of the fan blades for heating of air blown outwardly therefrom. Resilient biasing devices such as a bow springs are mounted in the fan blades extending over the slots to retain the heating elements in the slots. Electrically conductive ball bearings are included to facilitate rotation of the fan blade and hub while simultaneously providing electrical power to the heating elements during fan rotation. At least two bearings each individually maintain separate electrically conductive abutment respect to two separate conductive rings mounted in an insulating insert within the fan hub. Each ring is electrically conductive with respect to one end of each heating element for heating thereof during fan rotation.

20 Claims, 12 Drawing Sheets

ALL SEASON HEAT FAN WITH ELECTRIC HEATING ELEMENTS POWERED BY ROTATING RINGS AND BALL BEARINGS

This application for patent is a continuation-in-part of U.S. patent application Ser. No. 10/734,973 filed Dec. 15, 2003, on a Heat Fan, now abandoned. All priority rights including filing date priority are hereby formally claimed. and the parent application is hereby incorporated by reference herein for all purposes.

BACKGROUND OF THE INVENTION

1. Field of the Invention

Typically electric fans have been used to circulate air flow for cooling otherwise ambient environments. Other heaters have been used to provide supplementary heat in various areas by forcing air flow through heating elements wherein the air is warmed by the heater as it is forced to move through the heating elements. The present construction allows usage of a fan design for cooling or heating during all seasons. It is difficult to provide such constructions which are usable with fans that can oscillate, particularly pedestal fans, which are more useful in providing air circulation than stationary fans or blowers. Some electrically heated devices have been used to heat areas by placing a swivel fan in front of the heated element but this results in limited air circulation throughout the area. The construction of the present invention of heat fan provides cost effective means for circulation of heated air which is usable in many different environmental areas and applications. It has enhanced heating and air circulation capabilities which is usable in almost any ambient environment. It includes a unique means of transferring electrical power through the fan hub bearing to the heating element positioned on the rear surface of the fan blades.

2. Description of the Prior Art

Many patents have been granted on devices for moving and heating air simultaneously including fans and blowers and the like such as U.S. Pat. No. 1,737,912 patented Dec. 3, 1929 to F. T. Bogard and assigned to E. H. Christian on a "Rotary Heating Device"; and U.S. Pat. No. 1,784,528 patented Dec. 9, 1930 to O. F. Lidke et al and assigned to Lee A. Yoder on an "Electric Heating Apparatus"; and U.S. Pat. No. 2,110,621 patented Mar. 8, 1938 to I. H. Cohen and assigned to Thermal Units Manufacturing Company"; and U.S. Pat. No. 5,230,606 patented Jul. 27, 1993 to K. Fu on an "Electric Fan With Hot Air/Col.d Air Dual-Model Control"; and French Patent No. 942,017; and Italian Patent 464906; and British Patent Application GB 2 172 935 A, inventor S. Liaw on "A Cool And Warm Electric Fan"; and European Patent Application EP 0 964 211 A2; inventor M. Pigozzi on an "Electrically Heated Fan".

SUMMARY OF THE INVENTION

Temperature control by use of a unique heated fan is a primary advantage of the present invention. Control of air flow and temperature of the surrounding environment is made possible. Operation of the fan will gradually increase the temperature of surrounding air to reach the desirable temperature. The all season heat fan design of the present invention has been found to be particularly useful when used with a fan including an oscillating feature because it will provide better circulation of heated air than possible by any previous fan designs. Its unique construction and function is possible because of the particular designing of the fan and hub which allows the delivering of electrical current through sealed metal ball bearings to heating elements at least partially embedded in the fan blades.

The fan can rotate and deliver electric current to the heating elements at the same time. One of the advantages of the present invention is in the delivering of electric current through the metal ball bearings to the heating elements on the blades during powered rotation of the fan. This construction is particularly advanced in its simplicity, cost and effectiveness. Proper safety precautions have been included in this design to comply with requirement set forth by Underwriter's Laboratory. This fan may be used for all seasons by the inclusion of a thermostat for adjusting the supplying of electrical power to the heating element such that when heating is not necessary, the fan can be used a conventional fan.

The drive of the fan of the present invention is included in a housing which includes a front plate extending thereover. Preferably two electrical conductors extend outwardly through this plate and carry electrical current to be made available for heating of the heating elements. Heating elements are positioned in slots preferably defined on the rear surface of the fan to facilitate heating of air blown thereby. The individual fan blades are mounted in a fan hub and extend outwardly therefrom angularly to facilitate the movement of air therefrom.

Electrical communication between the two electrical conductors and the heating element is provided by including ball bearings mounted on the ends of the electrical conductors. These ball bearings are positioned in contact with respect to rings mounted inside of the fan hub. To facilitate electrical isolation a hub insert member preferably formed of an electrically insulating material such as silicone or rubber or thermoplastic is mounted within the fan hub with a first and second ring member of metallic conducting material mounted therein spaced apart from one another. A ball bearing is positioned on the end of each electrical conductor and in abutment with respect to the inside diameter of one of the rings to maintain electrical contact therewith. The individual heating elements mounted positioned in the slot on the fan blade surface extend through the hub and through the hub insert into electrical communication with respect to the two rings. In a preferred embodiment as shown in the present invention springs are positioned between the first and second ends of each heating element and the rings adjacent to which they are positioned to maintain contact therebetween during fan rotation. These springs will be in abutment with respect to the respective ends of the heating elements as well as being in contact with the outside surface of the respective rings for the purpose of maintaining full electrical flow between the heating elements and the respective electrical conductors at all times and especially during operation of the drive motor and the resulting rotation of the fan blades.

The heating elements are maintained in the slots by positioning of holding members thereover preferably in the form of bow springs which are secured by a bow securement device such as a screw or the like directly into the fan blade itself. Preferably a single attachment point is included which allows the bow spring to be rotated away from the slot to facilitate replacement and/or maintenance of the heating elements positioned therein more easily.

The present invention will preferably include a safety kill switch which will be operative to terminate all electrical power to the apparatus of the present invention responsive to the fan device being in any position other than upright. In this manner, if the unit is tipped or falls on its side, then no danger will exist because power supplied to the fan and to the heating elements will e automatically terminated. Such a safety kill switch can be most easily positioned in the base of a pedestal version of this fan apparatus.

It is an object of the present invention to provide an all season heat fan apparatus which simplifies means for heating air within a predefined environment.

It is an object of the present invention to provide an all season heat fan apparatus which provides electrical power to heating elements mounted in a fan blade which extends through bearings mounted inside of the fan hub.

It is an object of the present invention to provide an all season heat fan apparatus which is easy and convenient to use.

It is an object of the present invention to provide an all season heat fan apparatus which has minimal maintenance requirements.

It is an object of the present invention to provide an all season heat fan apparatus which can be used with a pedestal fan or any other different type of fan design.

It is an object of the present invention to provide an all season heat fan apparatus which can be utilized with fans of greatly varying different sizes and during many different temperatures and all seasons.

BRIEF DESCRIPTION OF THE DRAWINGS

While the invention is particularly pointed out and distincly claimed in the concluding portions herein, a preferred embodiment is set forth in the following detailed description which may be best understood when read in connection with the accompanying drawings, in which:

DETAILED DESCRIPTION OF THE PREFERRED EMBODIMENT

Figure 1:
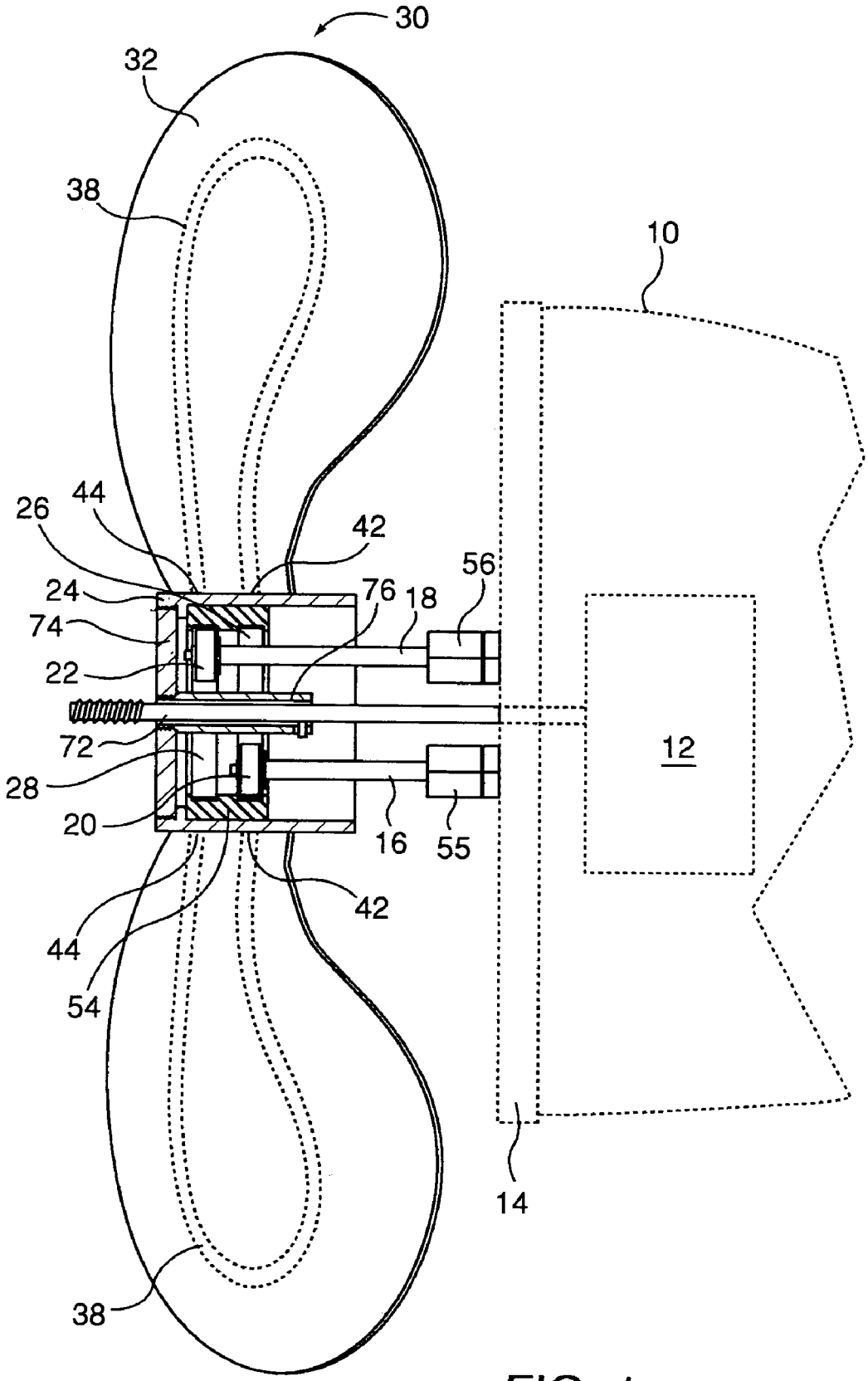
FIG. 1 is a side cross-sectional view of an embodiment of the all season heat fan of the present invention.
Figure 2:
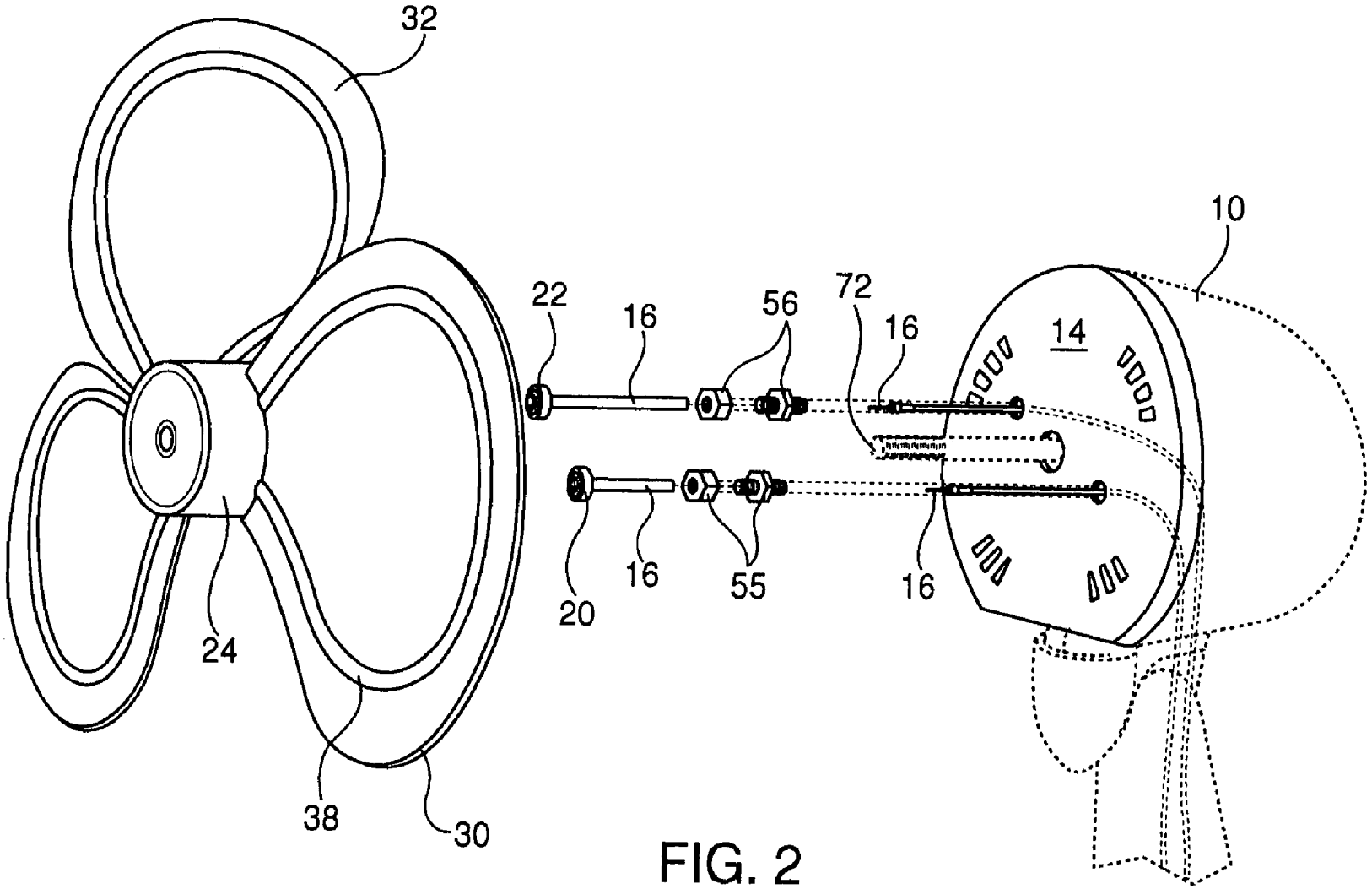
FIG. 2 is a perspective illustration of an embodiment of an all season heat fan of the present apparatus showing the electrical conductors and collets and bearings extending outwardly from the front plate of the housing assembly.
Figure 3:
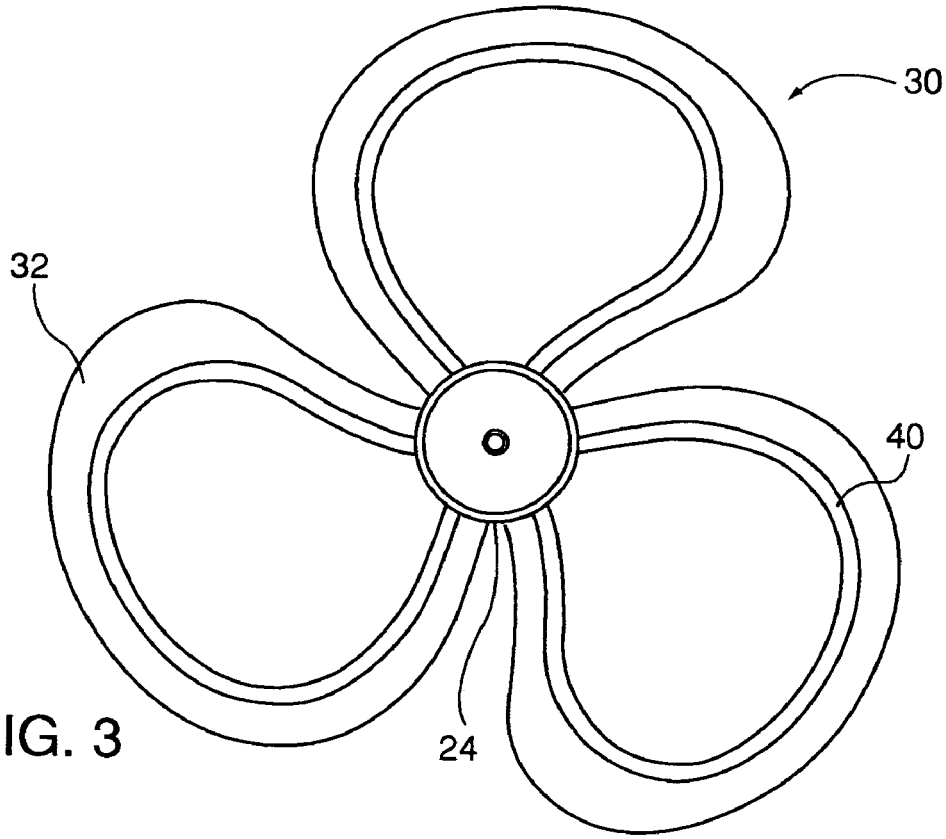
FIG. 3 is a front plan view of an embodiment of a fan plate usable with the present invention.
Figure 4:
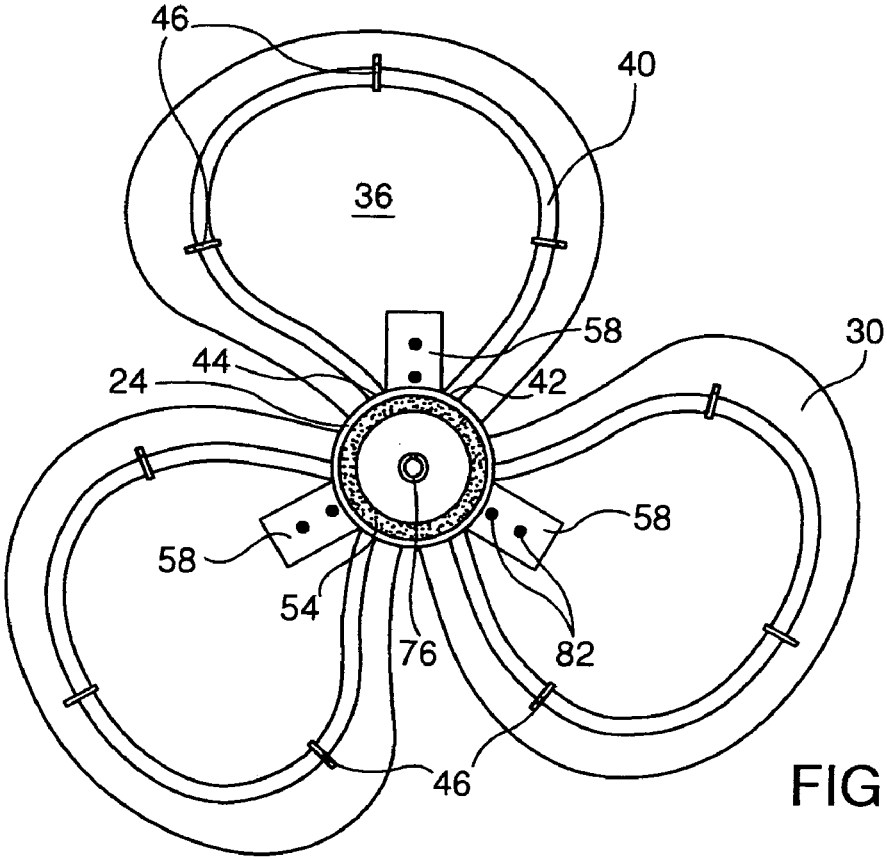
FIG. 4 is a rear plan view of an embodiment of a fan plate usable with the present invention.

The present invention covers a unique configuration for an all season heating fan device, which is usable during all times of the year when cooling is desired like in the summer or when heating is desired like in the winter. The unit will include a housing 10 for the positioning of a drive means 12 such as a motor or the like therewithin. A front plate 14 will extend over the opening in the housing 10 with the driveshaft 72 of drive motor 12 extending outwardly therefrom and being freely rotatable responsive to powering of the drive means.

The fan construction will include a fan hub 24 with a hub cap 74 extending over the front opening thereof and allowing a driveshaft mounting tube 76 to be positioned therewithin and extending rearwardly toward the housing 10 and in alignment with the driveshaft 72. Preferably driveshaft 72 will engage the driveshaft mounting tube 76 in such a manner as to power rotation thereof. Driveshaft mounting tube 76 and hub cap 74 and fan hub 24 will be securely mounted with respect to one another such that powered rotation of the driveshaft 72 will cause powered rotation of the fan hub 24. The individual fan blades 32 of the fan 30 will be mounted to the fan hub 24 through fan mounting brackets 58. Each fan mounting bracket 58 will include fan mounting holes 82 defined therein to facilitate the fixed securement of the fan blades 32 with respect to the fan hub 24. Preferably the individual fan blades 32 will be mounted at an angle 60 relative to the rotational direction of movement of the fan 30 to facilitate movement of air thereby and to facilitat heating of air when caused by rotation of the fan.

An important aspect of the present invention is in the means of communicating electrical current to the heating element means 40. These heating elements 40 will preferably be mounted within slots 38 defined in the rear fan surface 36 which is positioned oppositely from the front surface 34. Each heating element will include a first heating end 42 and a second heating end 44.

Electrical power flow from the stationary housing 10 to the heating elements 40 which are rotating with the fan 30 is through electrical conductors 16 and 18. A first electrical conductor 16 and a second electrical conductor 18 are mounted in collets defined in the front plate 14 of housing 10. A first collet assembly 55 is mounted in front plate 14 with the first electrical conductor 16 extending therethrough. Similarly a second collet assembly 56 is mounted in the front plate 14 of the housing 10 with the second electrical conductor 18 extending outwardly therethrough. Each of the first and second collet assemblies 55 and 56 are made of an electrically insulating material to isolate the first and second electrical conductors 16 and 18 from the front plate 14 and are positioned apart from one another to achieve electrical isolation between the first and second electrical conductors 16 and 18 to prevent shorting.

The first electrical conductor 16 and the second electrical conductor 18 extend outwardly from the point of mounting in the front plate 14 toward and into the fan hub 24. Preferably each of the electrical conductors will include a ball bearing means mounted in electrical communication on the outer portion thereof. In the preferred embodiment shown in FIG. 1 a first ball bearing means 20 will be mounted to the first electrical conductor 16 near the outermost end thereof within the fan hub 24 at a position inside of an abutment with respect to a first ring member 26 mounted within fan hub 24. In a similar manner a second ball bearing means 22 will be mounted on the second electrical conductor 18 at a position farther away from the front plate 14 than the first ball bearing means 20 in abutment with the inside surface of a second ring member 28.

The first and second ring members 26 and 28 are both preferably mounted within the fan hub 24 by being positioned within a hub insert member 54. Hub insert member 54 is preferably positioned within the fan hub 24 and includes the first and second ring members 26 and 28 mounted therein electrically insulated from one another and electrically insulated from the fan hub 24 itself. The fan hub 24 will preferably be formed of an electrically insulating material such as silicone, rubber, thermoplastic or any other electrically insulating material in order to facilitate electrical isolation of the power flow path to the heating means 40 on each fan blade 32. In the embodiment shown in FIG. 1 the first ring member 26 will be positioned closer to the housing 10 than the second ring member 28 in order to be properly aligned with the first and second ball bearing means 20 and 22. Also it is preferable that the portion of the first electrical conductor 16 and the second electrical conductor 18 be further electrically insulated by placing a vinyl exterior insulation sheathing 80 extending thereover between the respective collet assembly and the respective ball bearings.

The means of positioning of the heating means 40 on the rear fan surface 36 is an important consideration of the present invention. Preferably the rear fan surface 36 will define at least one slot 38 extending thereover into which the heating element 40 can be positioned. The heating element 40 can be a round or oval design but will be positionable within the slot 38 for facilitating holding of the heating element in place on the desired area of the rear fan surface 36. A holding member 46 will be included for the purpose of retaining the heating element members 40 in the slots 38. These holding members preferably comprise individual bow spring members 48 which are securable through a bow securement means such as a screw 50 directly to the rear fan surface 36 securing of the holding members 46 in place. Preferably each bow spring member 48 or holding member 46 includes an arcuate bow section 52 extending over the adjacently positioned heating element 40 while it is positioned within the slot 38 for the purpose of retaining it as desired. The use of a single screw as the bow securement means 50 has the advantage of allowing the bow spring member 48 to be rotated away from the position extending over the slot 38 to facilitate replacement and/or maintenance of the heating elements 40 which tend to need replacement over long terms of usage.

Figure 5:
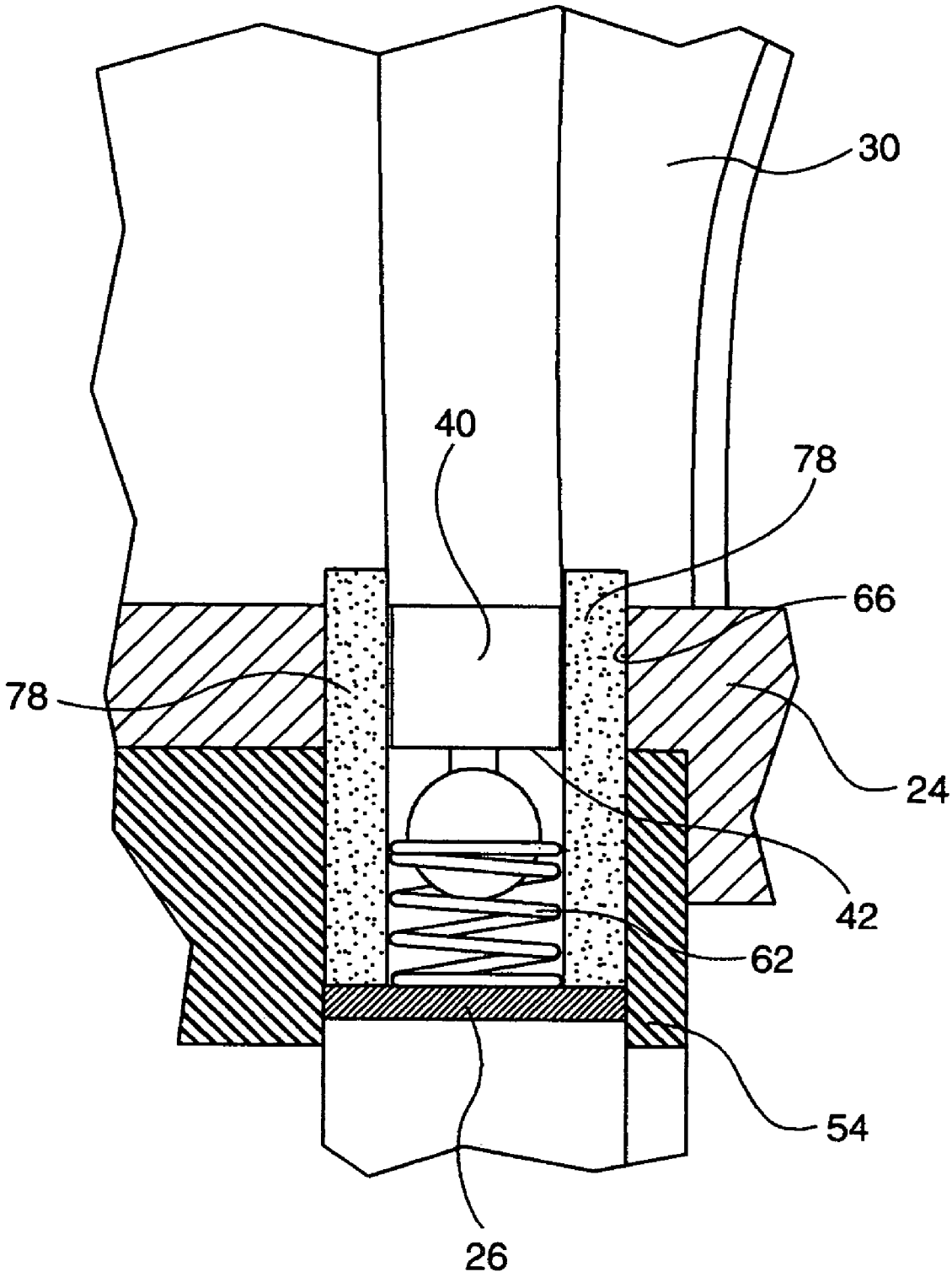
FIG. 5 is an exploded illustration of the intersection between an embodiment of the heating element of the present invention and the adjacent ring member with the spring means positioned therebetween for maintaining contact.
Figure 6:
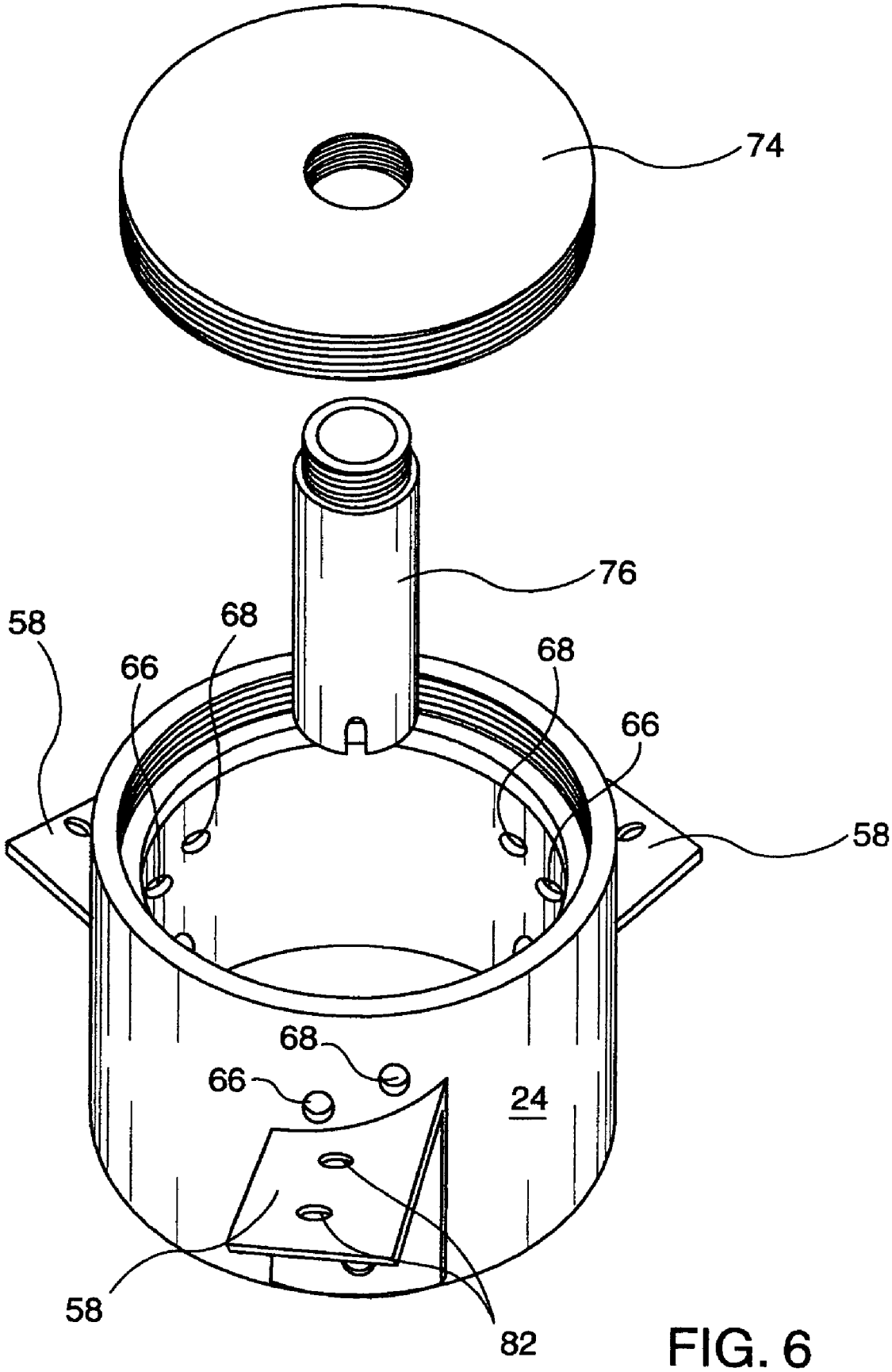
FIG. 6 is an assembly view of an embodiment of the hub assembly of the present invention showing the hub, hub cap and driveshaft mounting tube thereof.
Figure 7:
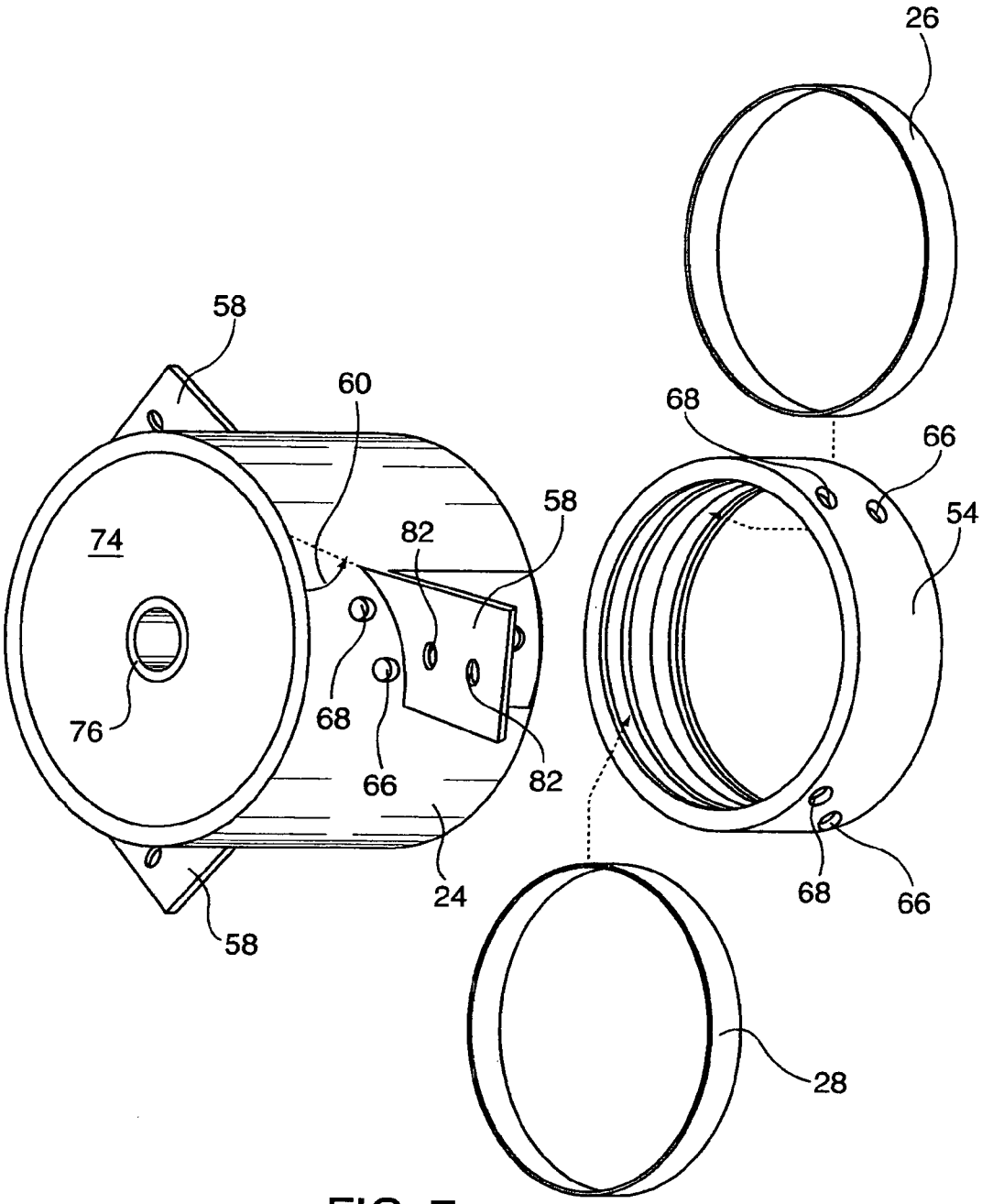
FIG. 7 is an exploded view showing the exterior of the hub assembly with mounting brackets extending outwardly therefrom and the hub insert member with slots defined therein for holding two metallic rings spaced apart from one another.
Figure 8:
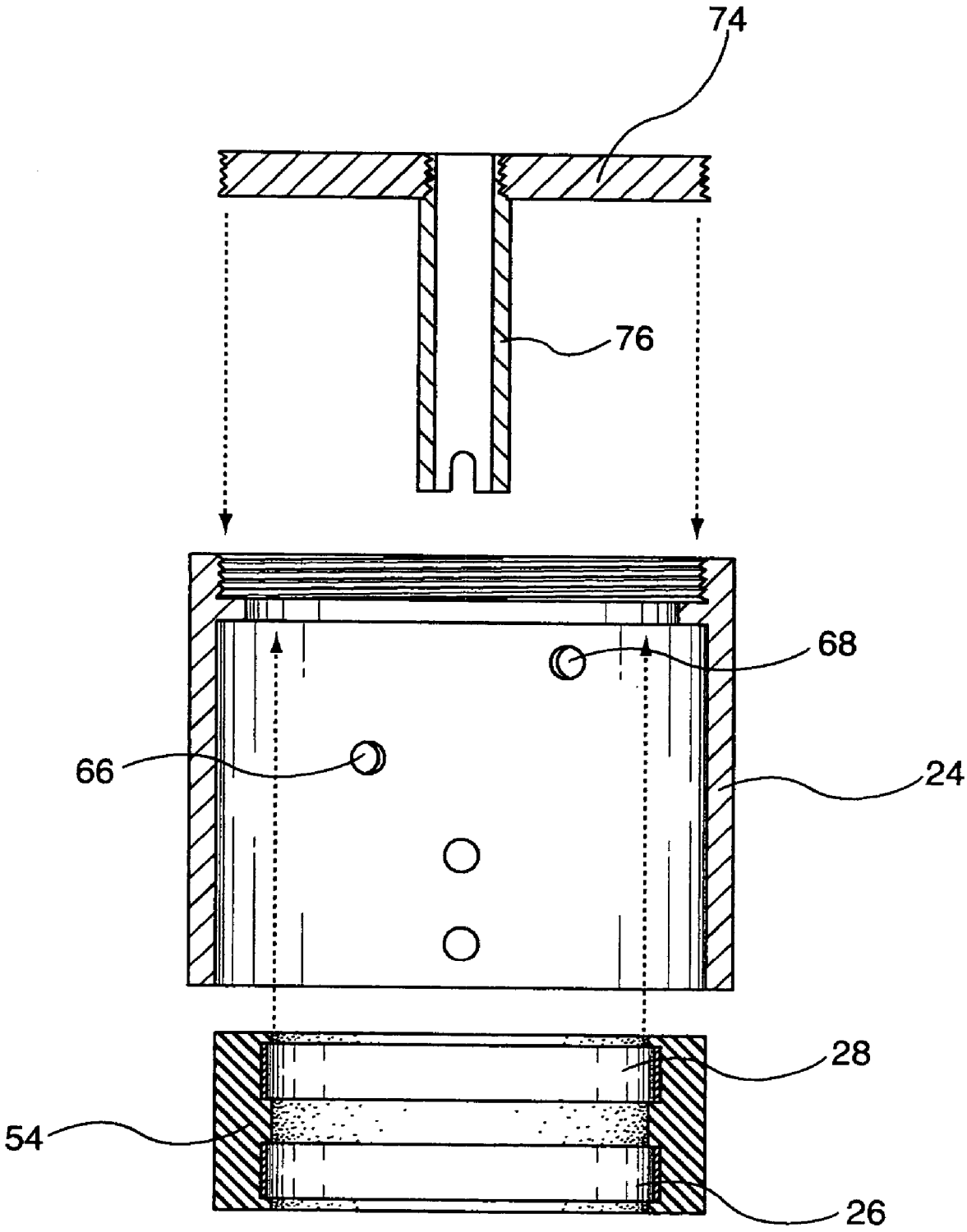
FIG. 8 is an assembly view of the hub assembly shown vertically oriented with respect to the hub cap and driveshaft mounting tube as well as the hub insert member.
Figure 9:
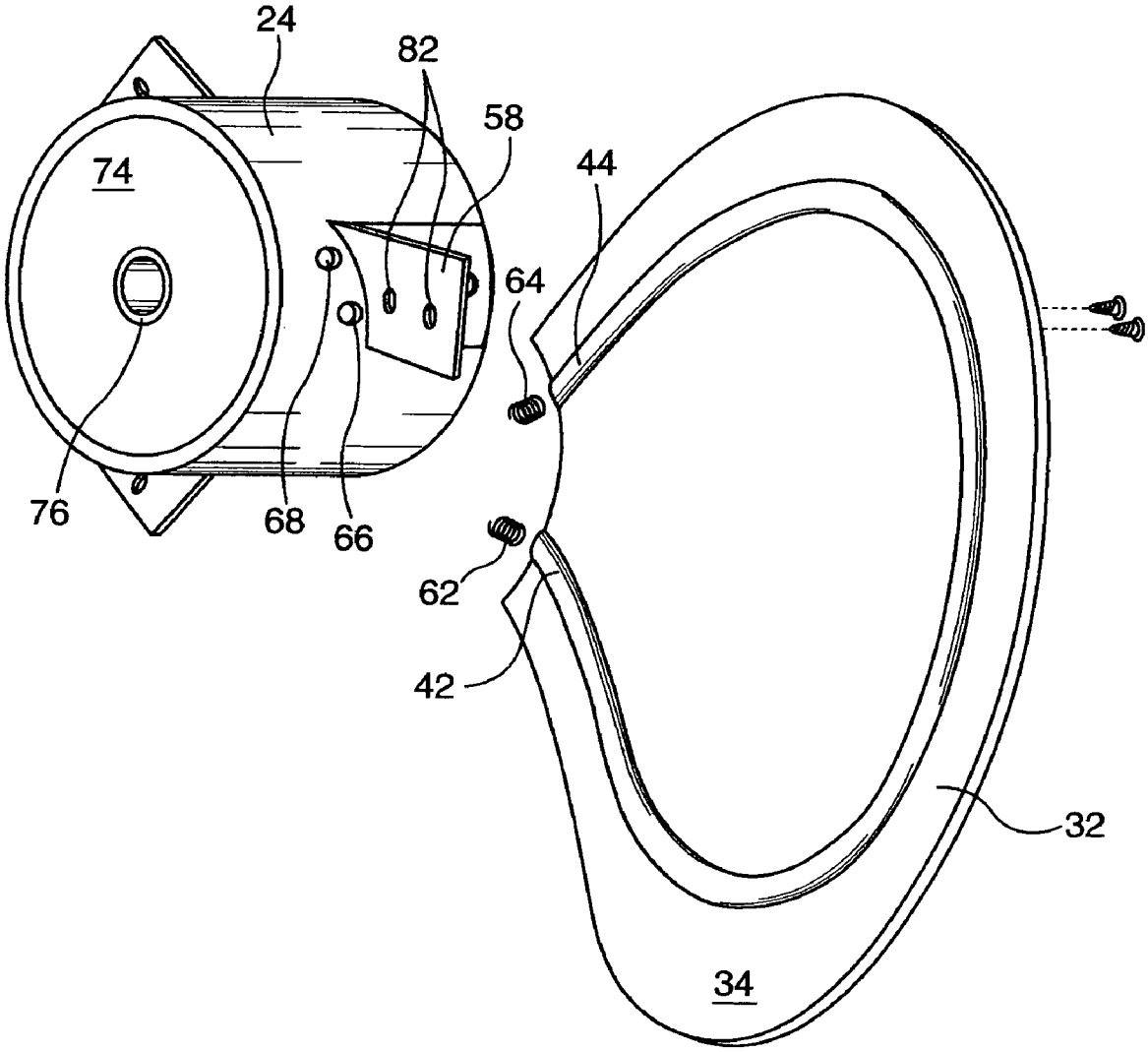
FIG. 9 is a perspective illustration showing the manner of attachment of an embodiment of the fan hub of the present invention through the fan mounting brackets to the fan blades while maintaining electrical contact therebetween through the springs.
Figure 10:
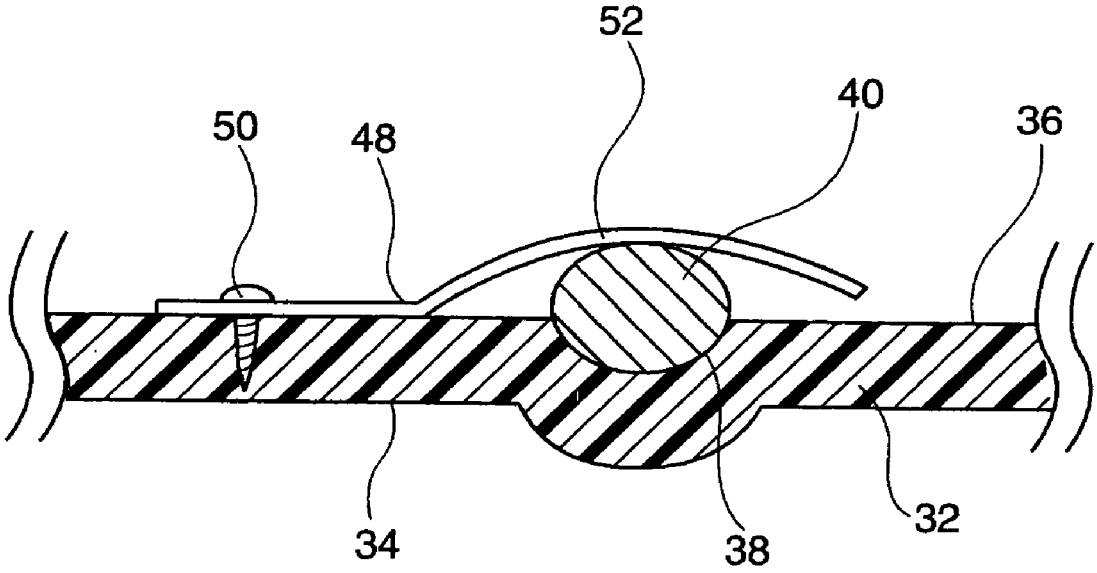
FIG. 10 is a cross-sectional illustration of an embodiment of the fan blade showing the slot defined therein with the heating member positioned therein and a bow spring secured to the fan with an arcuate section thereof extending over the heating member for holding it in place within the slot.
Figure 11:
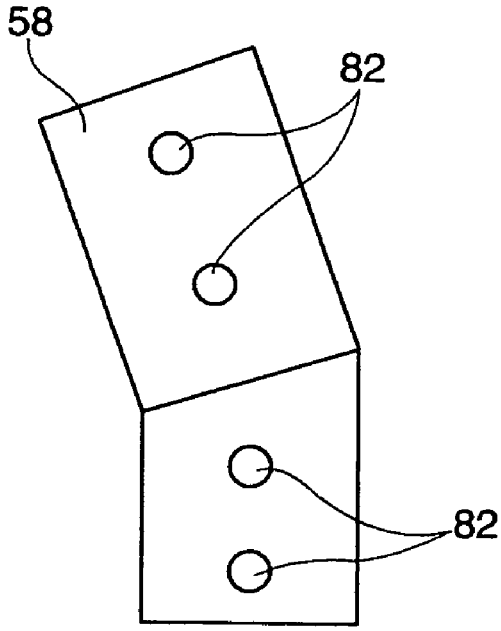
FIG. 11 shows an embodiment of the fan mounting bracket of the present invention.
Figure 12:
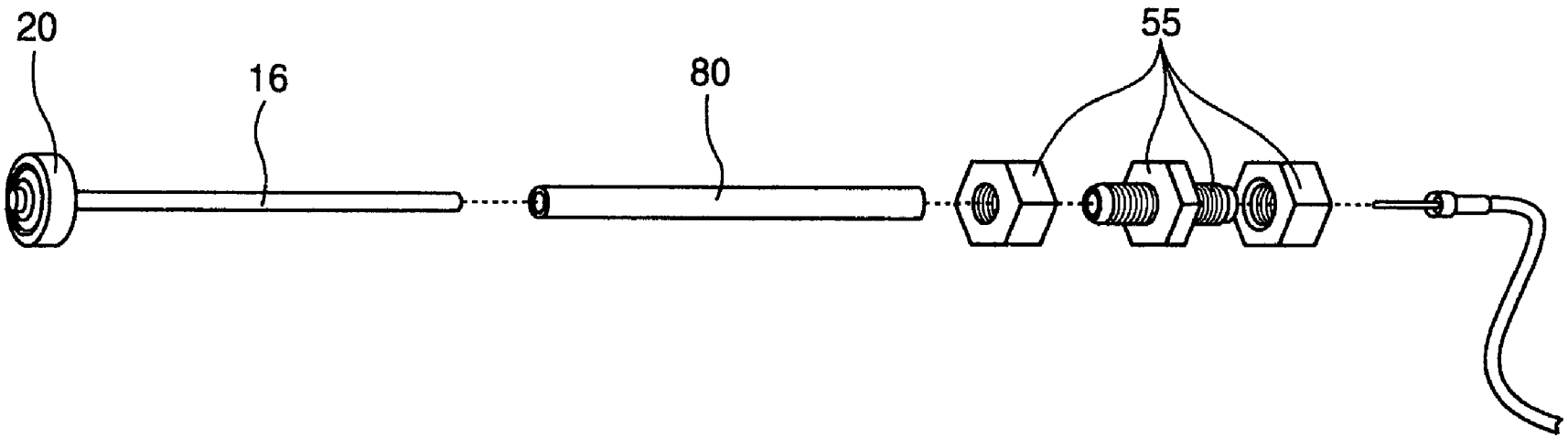
FIG. 12 is an assembly drawing of the line of electrical communication between the power input line and the first ball bearing means extending through the electrical conductor and collet assembly.

Another important consideration in the present invention is in the maintaining of electrical contact between the first heating end 42 and the outside surface of the first ring member 26 and also maintaining contact between the second heating end 44 and the second ring member 28. The maintaining of this contact to continuously supply heat to the heating elements is achieved by the configuration shown in FIG. 5. The first heating end 42 will include a first spring means 62 which is in engagement with the outer surface of the first ring member 26 will simultaneously being biased into engagement with the first heating end 42 of heating element 40. In some configurations the heating element 40 will include an electrical wire extending therefrom which further facilitates the maintenance of electrical contact therebetween. The flexibly resilient biasing of the first spring means 62 will facilitate continuous maintenance of contact between the external surface of the first ring member 26 and the first heating end 42 of heating means 40 despite any movement that may occur during rotation of the fan. A similar construction is utilized for the inner section between the second heating end 44 of heating element 40 and outside surface of the second ring member 28 by the inclusion of a second spring means 64. Both the first spring means and the second spring means are shown in FIG. 9.

To isolate the heating means 40 from the fan hub 24 the fan hub can define first heating element aperture 66 and second heating element apertures 68 therein. These apertures are defined in the fan hub 24 and are defined in the hub insert member 54 to allow the heating means 40 to extend therethrough as shown best in FIG. 5 to a position where the spring means will be immediately adjacent to the end of the heating tube and will be in contact with the outer surface of the ring member 26 and/or 28. To further isolate the heating element 40 from the fan hub 24 a ceramic or other electrically insulating tube 78 can be positioned within the first heating element apertures 66 and also within each of the second heating element apertures 68.

Figure 13:
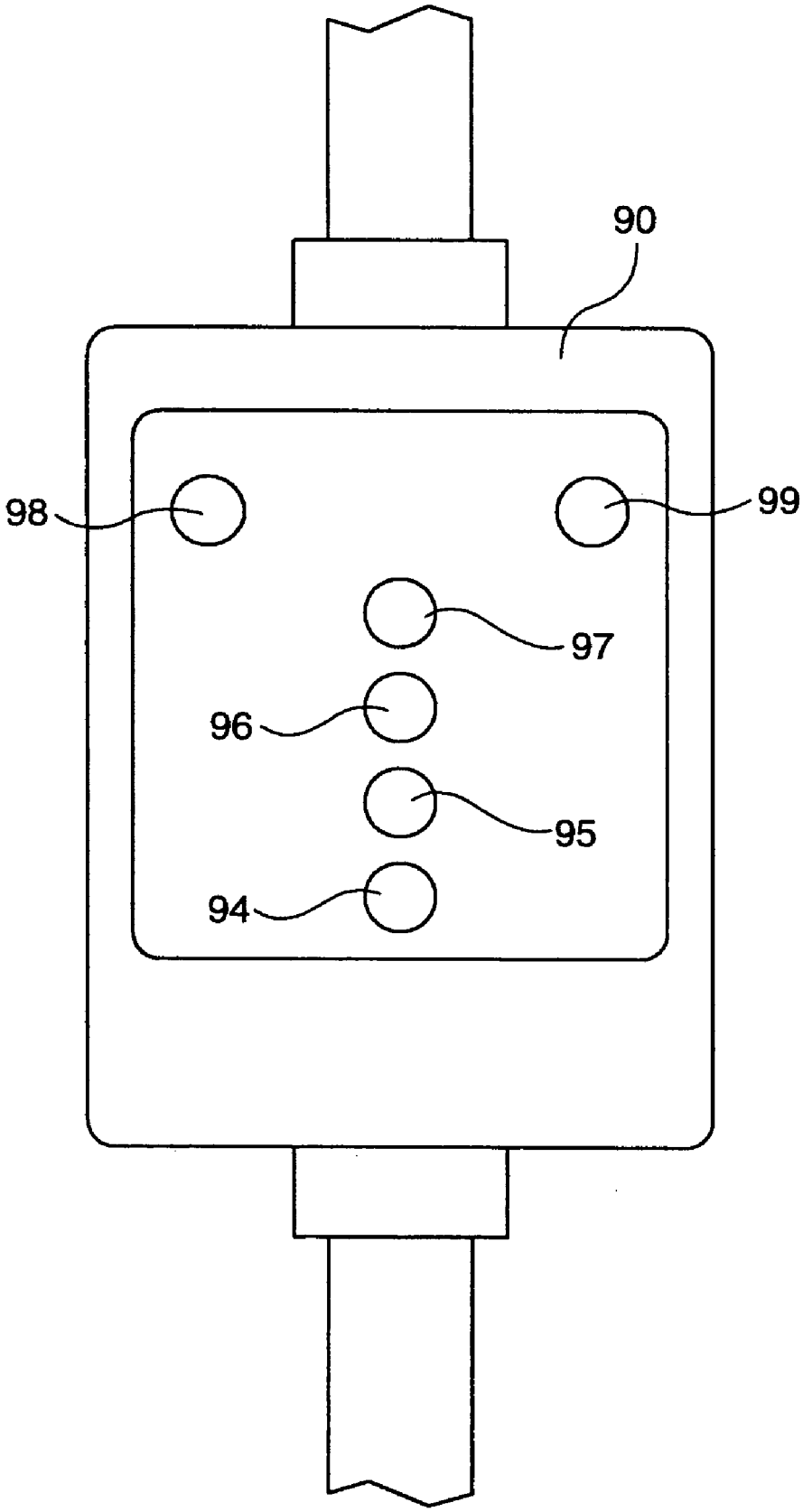
FIG. 13 is a front plan view of an embodiment of the present invention illustrating a control box for facilitating control of various modes of operation of the present invention.
Figure 14:
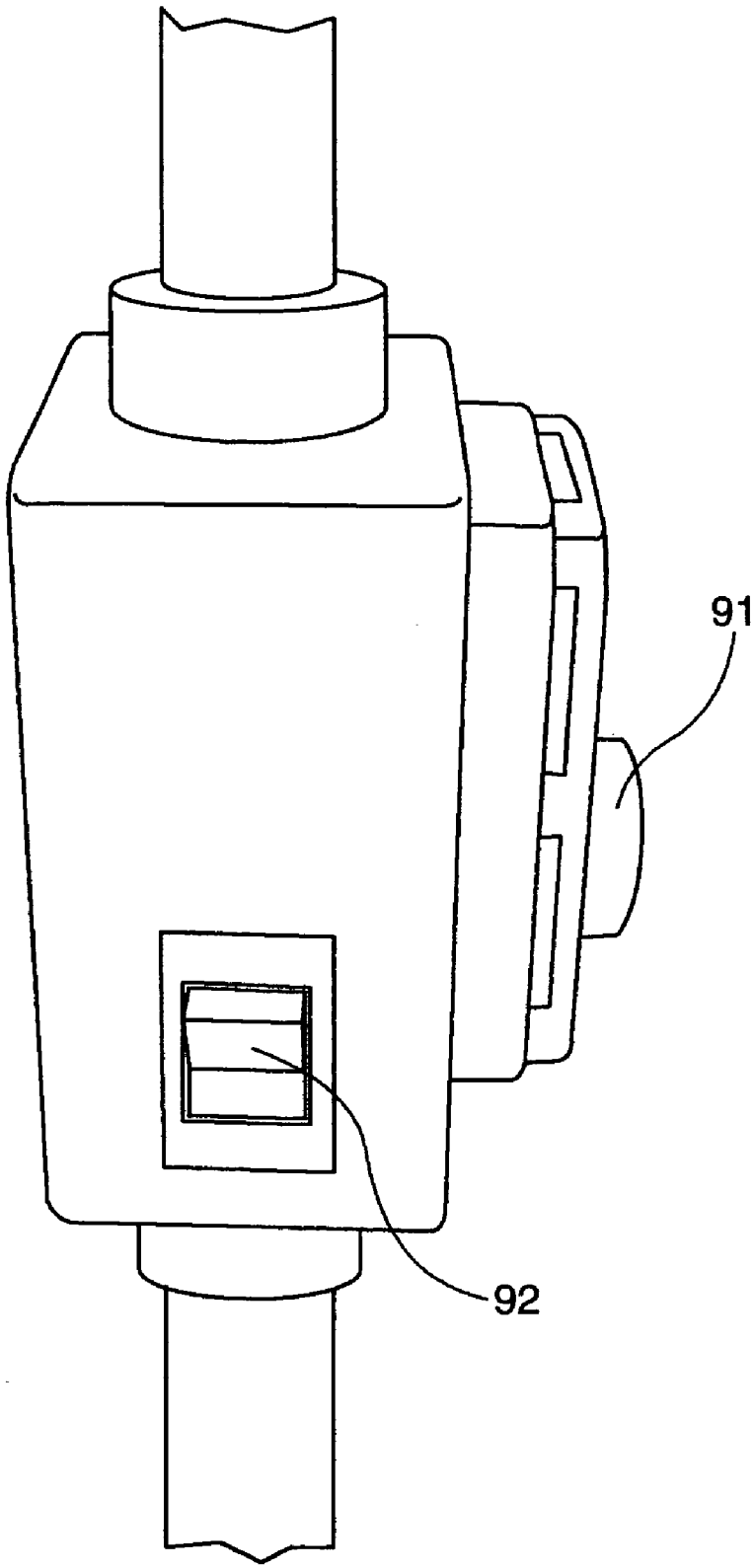
FIG. 14 is a side plan view of the embodiment shown in FIG. 13.

A control box housing 90 is preferably included in the present invention with a thermostat 91 positioned thereadjacent or therewithin. Control box 90 will hold the means of operating of the fan or heating apparatus. A preferred configuration is shown in FIGS. 13 and 14. A main power switch 92 is operative to allow or prevent electrical power from being supplied to both the fan and the heating elements thereof. Switch button 94 provides and on/off power switch for the fan. Buttons 95, 96 and 97 provide low, medium, and high speed fan rotation speed, respectively. Also, indicator lights are preferably included. Light 98 in this preferred embodiment is the indicator light for showing power is being supplied to the unit and light 99 is the indicator light for showing that the heating elements are operational. This control box housing is preferably mounted in the vertical stand of the pedestal fan embodiment, but is usable with many different fan configurations which includes the noval aspects of the present invention. A safety kill switch is also preferably included which will stop all power to the fan or to the heating elements if the fan is in any orientation other than being upright.

While particular embodiments of this invention have been shown in the drawings and described above, it will be apparent that many changes may be made in the form, arrangement and positioning of the various elements of the combination. In consideration thereof, it should be understood that preferred embodiments of this invention disclosed herein are intended to be illustrative only and not intended to limit the scope of the invention.

I claim:

1. An all season heat fan apparatus with electric heating elements powered by rotating rings and ball bearings comprising:

A. a housing:

B. a drive means mounted in said housing;

C. an electrical conductor means mounted within said housing and extending outwardly therefrom, said electrical conductor means being operatively connected to a source of electrical power for conducting current therethrough;

D. a ball bearing means mounted upon said electrical conductor means and being rotatably movable with respect thereto, said ball bearing means being electrically conductive with respect to said electrical conductor means;

E. a fan hub fixedly mounted with respect to said drive means to be rotatably movable therewith; and F. a ring means fixedly mounted within said fan hub and rotatably driven therewith, said ring means being continuously positioned in abutment with respect to said ball bearing means to maintain electrical conductivity therewith;

G. a fan means fixedly secured with respect to said fan hub and including a plurality of individual fan blades extending outwardly from said fan hub, each fan blade defining a slot means therewithin; and H. a heating means positioned at least partly within said slot means defined in said fan blades to facilitate heating of air being blown therefrom.

2. An all season heat fan apparatus with electric heating elements powered by rotating rings and ball bearings as defined in claim 1 wherein said electrical conductor means includes:

A. a first electrical conductor fixedly mounted with respect to said housing and extending outwardly therefrom; and B. a second electrical conductor fixedly mounted with respect to said housing and extending outwardly therefrom.

3. An all season heat fan apparatus with electric heating elements powered by rotating rings and ball bearings as defined in claim 2 wherein said ball bearing means includes:

A. a first ball bearing means rotatably mounted on said first electrical conductor and in electrical conductance therewith; and B. a second ball bearing means rotatably mounted on said second electrical conductor and in electrical conductance therewith, said second ball bearing means being electrically insulated from said first ball bearing means.

4. An all season heat fan apparatus with electric heating elements powered by rotating rings and ball bearings as defined in claim 3 wherein said ring means includes:

A. a first ring member fixedly mounted within said fan hub in position maintaining electrically conductive contact with said first ball bearing means during rotational driving of said fan means; and B. a second ring member fixedly mounted within said fan hub in position maintaining electrically conductive contact with said second ball bearing means during rotational driving of said fan, said second ring member being electrically insulated from said first ring member.

5. An all season heat fan apparatus with electric heating elements powered by rotating rings and ball bearings as defined in claim 4 wherein each of said heating means located on each of said fan blades includes a first heating end and a second heating end and wherein all of said first heating ends are maintained in electrically conducting contact with respect to said first ring member during rotational movement of said fan and wherein all of said second heating ends are maintained in electrically conducting contact with respect to said second ring member during rotational movement of said fan.

6. An all season heat fan apparatus with electric heating elements powered by rotating rings and ball bearings as defined in claim 1 further comprising a plurality of holding members mounted to said fan blades adjacent said slot means defined therein for extending thereover to facilitate retaining of said heating means in position thereadjacent extending at least partially within said slot means.

7. An all season heat fan apparatus with electric heating elements powered by rotating rings and ball bearings as defined in claim 6 wherein each of said holding members includes a bow spring member extending over said heating means for biasing thereof into said slot means.

8. An all season heat fan apparatus with electric heating elements powered by rotating rings and ball bearings as defined in claim 4 further comprising a hub insert member positioned within said fan hub with said first ring member and said second ring member mounted therewithin spatially disposed from one another, said hub insert member being made of an electrically insulating material to facilitate electrical insulation of said first ring member and said second ring member.

9. An all season heat fan apparatus with electric heating elements powered by rotating rings and ball bearings as defined in claim 8 wherein said hub insert member is made of a silicone based material to facilitate electrical insulation thereof.

10. An all season heat fan apparatus with electric heating elements powered by rotating rings and ball bearings as defined in claim 2 further comprising a first collet assembly and a second collet assembly mounted with respect to said housing, said first collet assembly and said second collet assembly being made of electrically insulative material, said first electrical conductor means being mounted within said first collet assembly and said second electrical conductor means being mounted within said second collet assembly to facilitating electrical insulation therebetween and also for electrical insulation from said housing.

11. An all season heat fan apparatus with electric heating elements powered by rotating rings and ball bearings as defined in claim 10 wherein said housing includes a front cover member with said first collet assembly and said second collet assembly mounted therein spatially disposed from one another.

12. An all season heat fan apparatus with electric heating elements powered by rotating rings and ball bearings as defined in claim 4 wherein said second ball bearing means is rotatably mounted to said second electrical conductor at a position farther from said drive means than the position where said first ball bearing means is rotatably mounted to said first electrical conductor to facilitate contact between said first ball bearing means and said first ring member and to facilitate contact between said second ball bearing means and said second ring member.

13. An all season heat fan apparatus with electric heating elements powered by rotating rings and ball bearings as defined in claim 1 wherein said fan means includes a front fan surface and a rear fan surface with said rear fan surface defining said slot means therein adapted to receive said heating means mounted therewithin.

14. An all season heat fan apparatus with electric heating elements powered by rotating rings and ball bearings as defined in claim 1 further comprising a plurality of fan mounting brackets secured to said fan hub and extending outwardly therefrom, said fan means being mounted with respect to said fan hub by securement thereof with respect to said fan mounting brackets, each of said fan mounting brackets being angularly oriented with respect to said fan hub to facilitate mounting of said fan means at an angle with respect to said fan hub to facilitate movement of air thereby.

15. An all season heat fan apparatus with electric heating elements powered by rotating rings and ball bearings as defined in claim 5 further comprising a first spring means mounted between said first heating end of said heating means and said first ring member to facilitate maintaining of electrical contact therebetween during powered rotation of said fan means and also including a second spring means mounted between said second heating end of said heating means and said second ring member to facilitate maintaining of electrical contact therebetween during powered rotation of said fan means.

16. An all season heat fan apparatus with electric heating elements powered by rotating rings and ball bearings as defined in claim 4 wherein said first ring member and said second ring member are made of metallic material.

17. An all season heat fan apparatus with electric heating elements powered by rotating rings and ball bearings as defined in claim 5 wherein said fan hub defines a plurality of first heating element apertures therein adapted to receive said first heating end of each of said heating means extending therethrough to facilitate electrical communication with respect to said first ring member positioned therewithin and wherein said fan hub further defines a plurality of second heating element apertures therein adapted to receive said second heating end of each of said heating means extending therethrough to facilitate electrical communication with respect to said second ring member positioned therewithin.

18. An all season heat fan apparatus with electric heating elements powered by rotating rings and ball bearings as defined in claim 7 wherein each of said bow spring members includes a bow spring securement means extending through said bow spring and into engagement with respect to said fan means therebelow to facilitate holding of said bow spring immediately adjacent said slot means and extending thereover for selectively retaining said heating means therewithin.

19. An all season heat fan apparatus with electric heating elements powered by rotating rings and ball bearings as defined in claim 18 wherein said bow spring securement means allows selective pivotal movable of said bow spring with respect to said fan means to facilitate access to said heating means for replacement thereof.

20. An all season heat fan apparatus with electric heating elements powered by rotating rings and ball bearings as defined in claim 7 wherein said bow spring member includes an arcuate bow section secured extending over said slot means in said fan means to further facilitate retaining of said heating means positioned therewithin securely.

* * * * *